US009879682B1

(12) United States Patent
Beliveau et al.

(10) Patent No.: US 9,879,682 B1
(45) Date of Patent: Jan. 30, 2018

(54) INFLATING UNIT FOR USE WITH AN INFLATABLE OBJECT

(71) Applicant: Soft-Tex International, Inc., Waterford, NY (US)

(72) Inventors: John A. Beliveau, Mooresville, NY (US); Yingan Liu, HuaiAn (CN)

(73) Assignee: Soft-Tex International, Inc., Waterford, NY (US)

( * ) Notice: Subject to any disclaimer, the term of this patent is extended or adjusted under 35 U.S.C. 154(b) by 41 days.

(21) Appl. No.: 15/255,430

(22) Filed: Sep. 2, 2016

(51) Int. Cl.

| | |
|---|---|
| ***B65B 3/16*** | (2006.01) |
| ***F04D 17/16*** | (2006.01) |
| ***F17C 5/06*** | (2006.01) |
| ***F17C 13/02*** | (2006.01) |
| ***F04D 25/06*** | (2006.01) |
| ***F04D 29/42*** | (2006.01) |
| ***F04D 27/00*** | (2006.01) |
| ***F04D 29/66*** | (2006.01) |
| ***F04D 29/28*** | (2006.01) |

(52) U.S. Cl.
CPC ..... *F04D 17/16* (2013.01); *F04D 25/06* (2013.01); *F04D 27/001* (2013.01); *F04D 27/002* (2013.01); *F04D 29/281* (2013.01); *F04D 29/4206* (2013.01); *F04D 29/664* (2013.01); *F17C 5/06* (2013.01); *F17C 13/025* (2013.01); *F17C 2201/0176* (2013.01); *F17C 2250/03* (2013.01); *F17C 2250/043* (2013.01)

(58) Field of Classification Search
CPC ..... F04D 17/16; F04D 27/002; F04D 29/281; F04D 27/001; F04D 29/664; F04D 29/4206; F04D 25/06; F17C 5/06; F17C 13/025; F17C 2201/0176; F17C 2250/03; F17C 2250/043
See application file for complete search history.

(56) References Cited

U.S. PATENT DOCUMENTS 8,024,830 B2 9/2011 Wang et al.
8,863,771 B2 10/2014 Wang et al.

*Primary Examiner* — Jason K Niesz
(74) *Attorney, Agent, or Firm* — Heslin Rothenberg Farley & Mesiti P.C.

(57) ABSTRACT

A unit for inflating an inflatable object includes a first sub-system for initially inflating the inflatable object and a second sub-system for automatically adding air to the inflatable object when the air pressure within the object falls below a predetermined threshold after inflation. The air pressure within the inflatable object is monitored and measured by an electric pressure sensor that communicates with a PC circuit board. The unit allows air into and out of the inflatable object using a solenoid configured to open and close a valve. The first and second sub-systems are both contained within the same housing affixed to the inflatable object and use the same solenoid and valve to add air into the inflatable object.

11 Claims, 10 Drawing Sheets

INFLATING UNIT FOR USE WITH AN INFLATABLE OBJECT

FIELD OF THE INVENTION

The present invention relates to an inflating unit, and more particularly, to an inflating unit used to inflate an inflatable object and to provide additional air pressure to the inflatable object when the air pressure of the inflatable object is under a predetermined threshold.

BACKGROUND OF THE INVENTION

A conventional inflatable bed includes a built-in electric air pump for inflating a mattress of the inflatable bed. However, conventional inflatable beds are not capable of maintaining the inflation within the mattress to a precise threshold or level because, for example, they rely on air pumps that use mechanical components to monitor the air pressure within the mattress.

SUMMARY OF THE INVENTION

The shortcomings of the prior art may be alleviated by using an inflating unit constructed in accordance with one or more aspects of the present invention. The inflating unit of the present invention may be used in any type of inflatable unit such as, for example, an air bed or mattress, inflatable pool toys, tires, balloons, inflatable characters for advertisements or the like. Additionally, other uses may be made of the invention that fall within the scope of the claimed invention but which are not specifically described below.

In one aspect of the invention, there is provided a unit for inflating an inflatable object having an interior. The unit comprises a housing, a valve, a solenoid, a first sub-system, a second sub-system and an electric pressure sensor. The housing includes a housing interior, a first air inlet, a second air inlet and an air outlet. The first inlet and the second inlet are configured to allow air flow between outside the housing and the housing interior. The air outlet is configured to allow air flow between the housing interior and the interior of the inflatable object. The valve is configured to control air flow through the air outlet. The solenoid is configured to selectively open and close the valve in response to an electric signal. The first sub-system is enclosed within the housing interior. The first sub-system is programmed to activate the solenoid and open the valve to inflate the inflatable object to a predetermined threshold. The first sub-system includes a first motor and an impeller. The first motor includes a drive shaft to which the impeller is affixed. The first motor and the impeller selectively activate in response to an electric signal to allow air to flow between the first air inlet of the housing and the interior of the inflatable object through the valve. The second sub-system includes a casing contained within the housing interior. The casing includes a first chamber and a second chamber. The first chamber is in fluid communication with the second air inlet and with the second chamber. The second chamber is in fluid communication with the housing interior outside the casing. The second sub-system is programmed to activate the solenoid and open the valve to provide additional air flow to the interior of the inflatable object from the second air inlet after the inflatable object is inflated by the first sub-system to the predetermined threshold and after pressure within the inflatable object falls below the predetermined threshold. The second sub-system includes a second motor and a quiet room. The second motor is contained within the first chamber of the casing and configured to draw air through the second air inlet into the casing in response to an electric signal. The quiet room is contained within the second chamber of the casing and includes a first cavity, a second cavity, a third cavity, and a diaphragm separating the first cavity, second cavity and third cavity. The diaphragm includes a first opening permitting air flow from the first cavity into the second cavity and a second opening permitting air flow from the second cavity to the third cavity. At least the first cavity and the third cavity include noise absorbent material contained therein. The electric pressure sensor is configured to monitor air pressure in the interior of the inflatable object. The air pressure monitored by the electric pressure sensor is compared to the predetermined threshold to selectively activate the second motor and the solenoid.

Additional features and benefits will become apparent from the following drawings and descriptions of the invention. Other embodiments and aspects of the invention are described in detail herein and are considered a part of the claimed invention.

BRIEF DESCRIPTION OF THE DRAWINGS

The subject matter which is regarded as the invention is particularly pointed out and distinctly claimed in the claims at the end of the specification. The foregoing and other objects, features, and advantages of the invention are apparent from the following detailed description taken in conjunction with the accompanying drawings in which:

DETAILED DESCRIPTION

Figure 1:
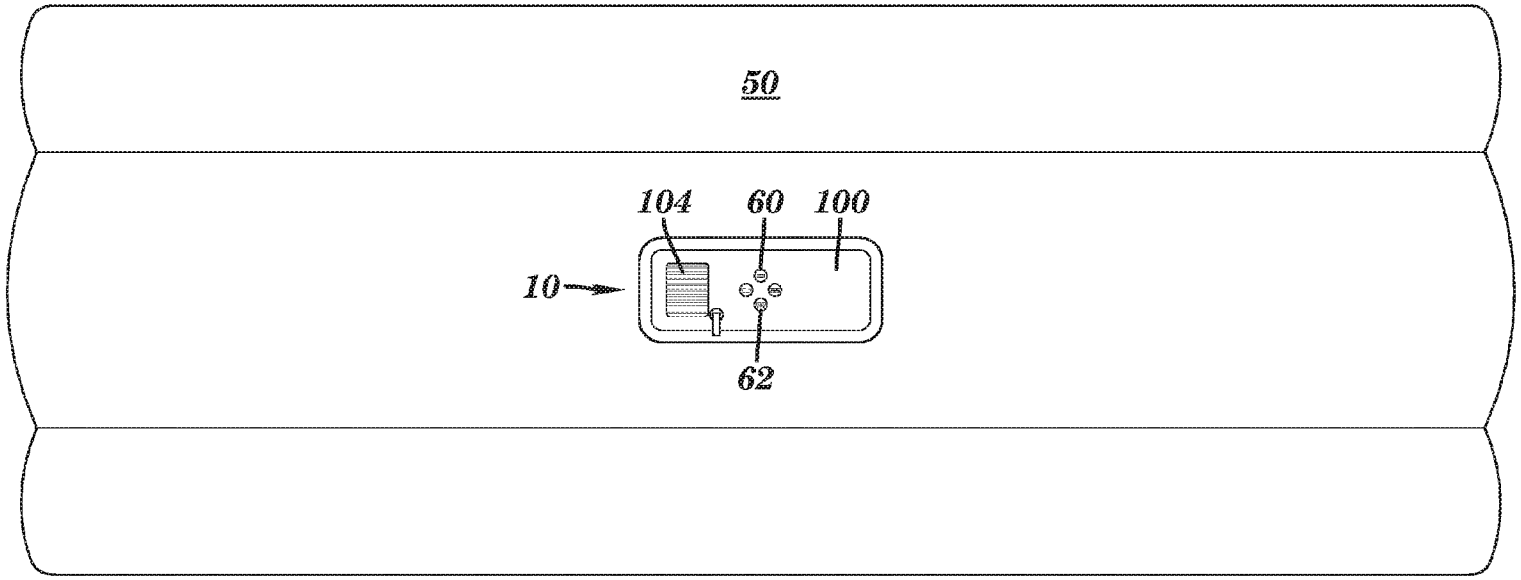
FIG. 1 is a perspective view showing one embodiment of an inflating unit constructed in accordance with one or more aspects of the present invention.

For the purposes of promoting an understanding of the principles of an inflating unit designed and constructed in accordance with one or more aspects of the present invention, reference will now be made to the embodiments, or examples, illustrated in the drawings and specific language will be used to describe these. It will nevertheless be understood that no limitation of the scope of the invention is thereby intended. Any alterations and further modifications in the described embodiments, and any further applications of the principles of the invention as described herein are contemplated as would normally occur to one skilled in the art to which the inflating unit invention relates.

Presented herein is an improved inflating unit capable of inflating and maintaining inflation of an inflatable object at or above a predetermined threshold or level. In traditional applications, an inflated object will eventually leak and result in a user having to constantly check and refill the inflated object to an undetermined air pressure. Past efforts have been attempted to automatically inflate an inflatable object after full inflation to maintain a desired air pressure. However, current inflating devices used to inflate and maintain air pressure within an inflatable object are compromised by, for example, the use of too many mechanical parts that require additional construction and cost and cause noise.

One example of such an attempt is described in U.S. Pat. No. 8,863,771. However, the inflating module described in this patent has many drawbacks and disadvantages. For example, the module for initially inflating the object and the module for adding supplemental air pressure to the object after full inflation are completely separate having separate housings and air outlets into the interior of the inflatable object. The approach described in this patent requires two housings being welded or attached to an inflatable object that increases the labor to assemble and the chances of failure or leakage. The inflating module described in this prior patent also requires a number of mechanical components to inflate/deflate and add supplemental air to the inflatable object. For example, the inflating module requires a valve controlling assembly having a rotating knob connected to a shaft that interacts with a pivoting air path mechanism. The inflating module also requires a supplemental air pressure providing device having a pole and diaphragm that moves up and down depending on the air pressure difference in an upper chamber and the interior of the inflatable object. With the use of so many mechanical components, the chances of failure and imprecision is high. Also, the use of mechanical components increases the noise caused by the inflating module during initial inflation and addition of supplemental air to the inflatable object.

Provided herein is an improved inflating unit capable of inflating an inflatable object and maintaining the air pressure within the inflatable object after inflation above a predetermined threshold. The predetermined threshold may be programmed and stored into a circuit board that receives and sends electric signals to various sub-systems all contained within a common housing connected to the inflatable object. In one example, the improved inflating unit includes a silence or quiet chamber and diaphragm configured to produce an effect that is less than two decibels when active and is not detectable by the human ear making it effective for not disrupting sleep. Other secondary air sources that currently exist produce more than two decibels which can disrupt sleep. The improved inflating unit uses the same housing as the main air supply.

By using the same housing for the initial inflation and the addition of additional air to an inflatable object, there is less to assemble and labor associated with the assembly. Also, with only one housing, the assembly only requires one welding of a housing to the inflatable object, which limits the risk of air leaks and assembly time. In one embodiment, air loss is monitored by an electric pressure sensor with a PC circuit board that is programmable to change the settings to determine when to provide additional air after full inflation. With the use of a PC circuit board and an electric pressure sensor rather than a mechanical setting, the specific air pressure can be precisely monitored and maintained.

Figure 2:
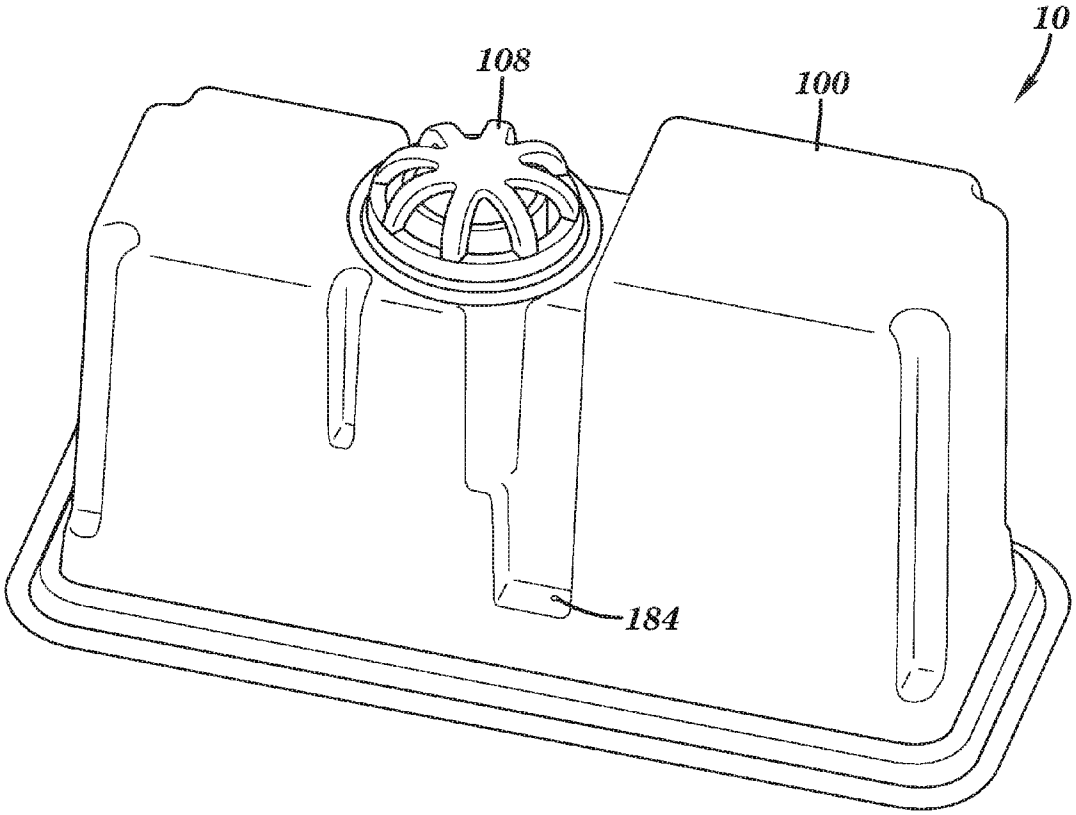
FIG. 2 is a perspective view of an example of a housing of one embodiment of an inflating unit constructed in accordance with one or more aspects of the present invention.
Figure 3:
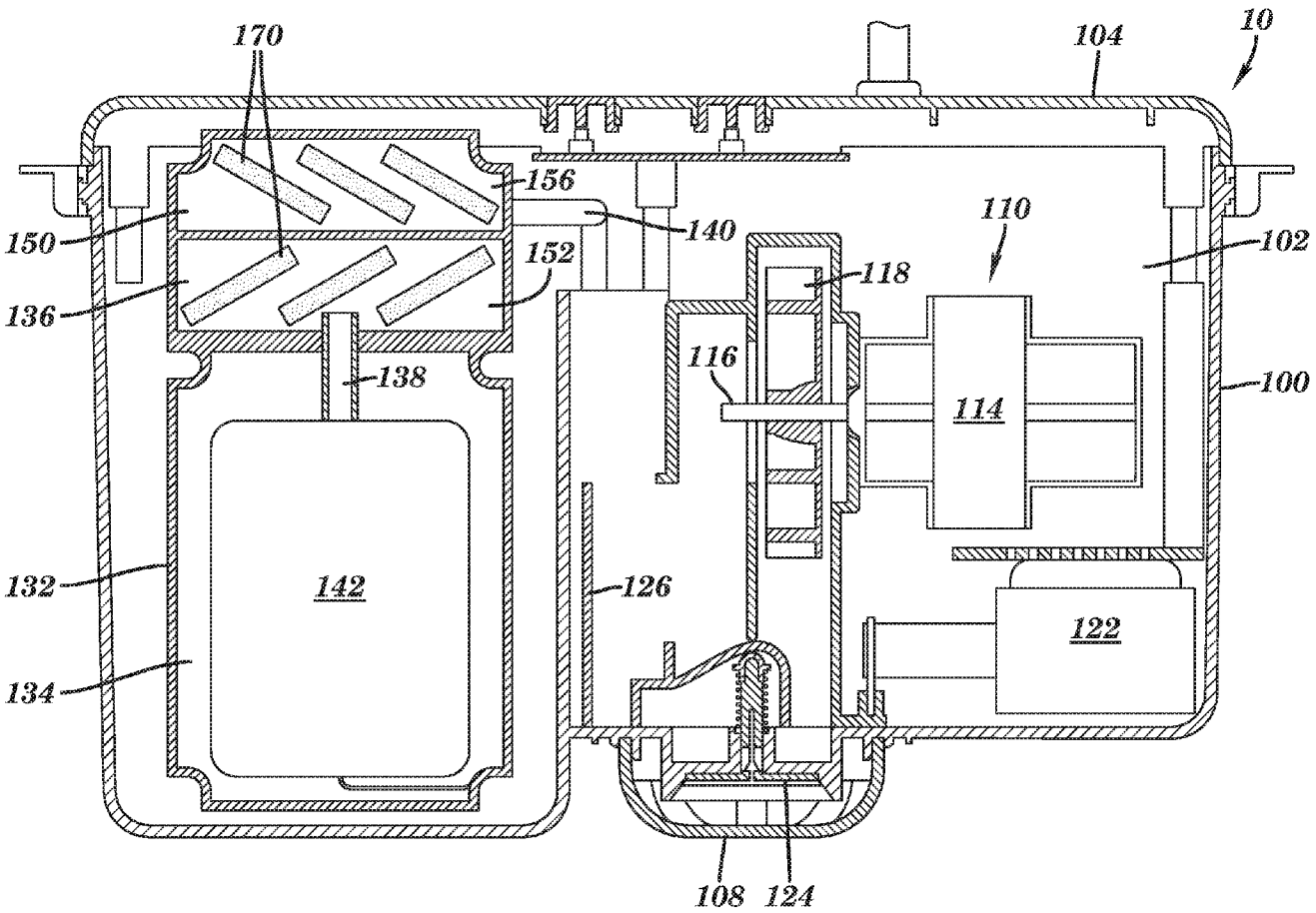
FIG. 3 is a cross sectional view showing examples of a first sub-system and a second sub-system contained within a housing of an inflating unit constructed in accordance with one or more aspects of the present invention.

FIGS. 1-3 depict an inflating unit 100 constructed in accordance with one or more aspects of the present invention used to inflate an air bed 50. Inflating unit 100 is secured by, for example, welding or glue to form an air tight seal with air bed 50. Inflating unit 100 includes an outer housing 100 defining a housing interior 102. Housing interior 102 is in fluid communication with interior of air bed 50. Housing 100 includes a first air inlet 104 allowing air to flow between outside housing 100 into housing interior 102, a second air inlet 106 allowing air to flow between outside housing 100 into housing interior 102 and an air outlet 108 allowing air to flow between housing interior 102 and interior of air bed 50.

Figure 4:
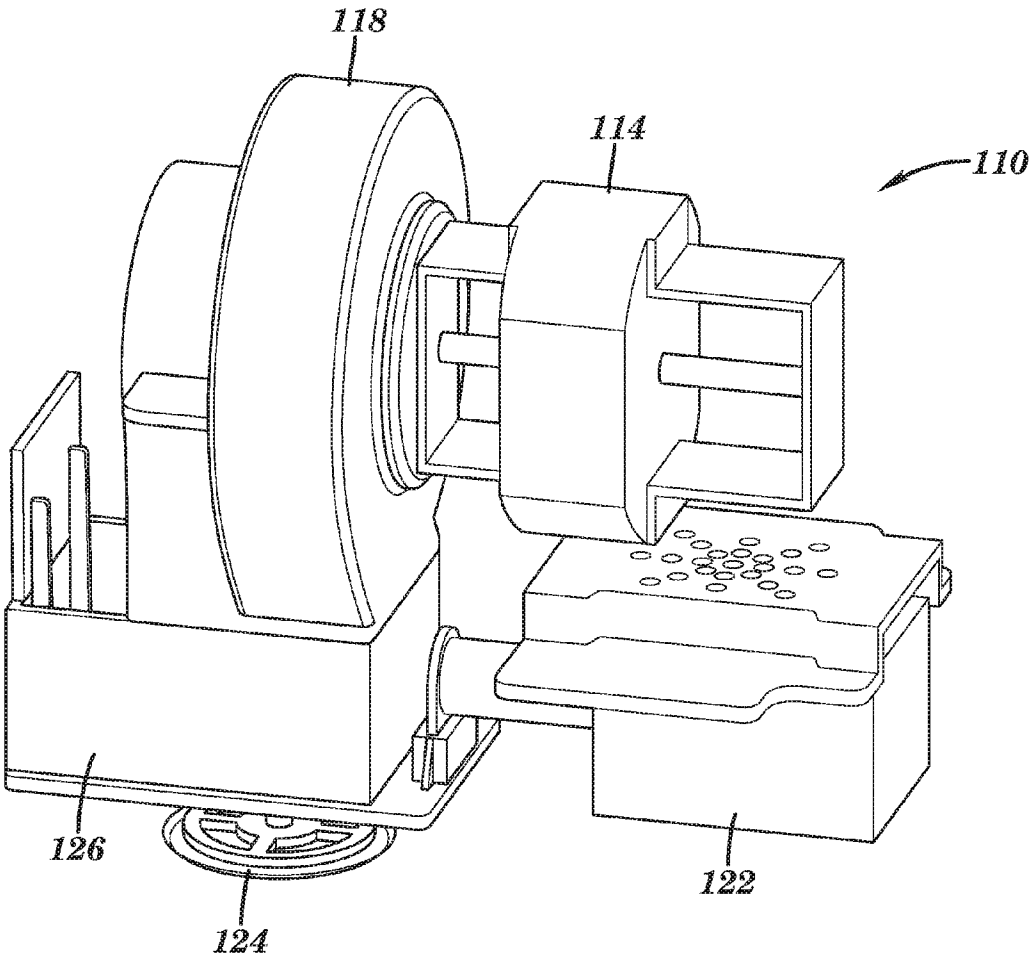
FIG. 4 is a perspective view of an example of a first sub-system of an inflating unit constructed in accordance with one or more aspects of the present invention.

Within housing interior 102, inflating unit 100 includes a first sub-system 110 and a second sub-system 130. First sub-system 110 is configured and programmed to inflate air bed 50 until the air pressure within interior of air bed 50 reaches a predetermined threshold. The predetermined threshold may be programmed into a circuit board that activates or deactivates first sub-system 110 depending on the air pressure within interior of air bed 50. First sub-system 110 may be activated by, for example, a button 60 on the outside of housing 102. In an alternative embodiment, first sub-system 110 may be activated by pressing a button on a remote control that communicates with a circuit board. The remote control may be hard wired directly to the circuit board or, alternatively, may communicate by Bluetooth, radio frequency or other known wireless communication technology. Once the air pressure within interior of air bed 50 reaches the predetermined, programmed threshold, first sub-system 110 is deactivated and air bed 50 is considered inflated In one embodiment as illustrated in FIGS. 3-4, first sub-system 110 includes a motor 114 including a drive shaft 116 affixed to an impeller 118. Upon activation of first sub-system 110, an electric signal is sent to motor 114 to rotate drive shaft 116 and impeller 118. Rotation of impeller 118 draws air in through first inlet 104 as, for example, indicated by air flow arrows 120 depicted in FIG. 5. At the same time, an electric signal is sent from a circuit board to a solenoid 122 that opens a valve 124 positioned in air outlet 108 to allow the air to flow from housing interior 102 into interior of air bed 50. In one embodiment, solenoid 122 is affixed to a reversing plate 126 that defines a particular flow path for the air drawn into housing interior 102 by impeller 118 and directs air flow toward air outlet 108 through valve 124. Once the air pressure within air bed 50 reaches the predetermined threshold programmed into the circuit board, an electric signal is sent to motor 114 to stop rotation of drive shaft 116 and impeller 118 and to solenoid 122 to close valve 124.

Figure 5:
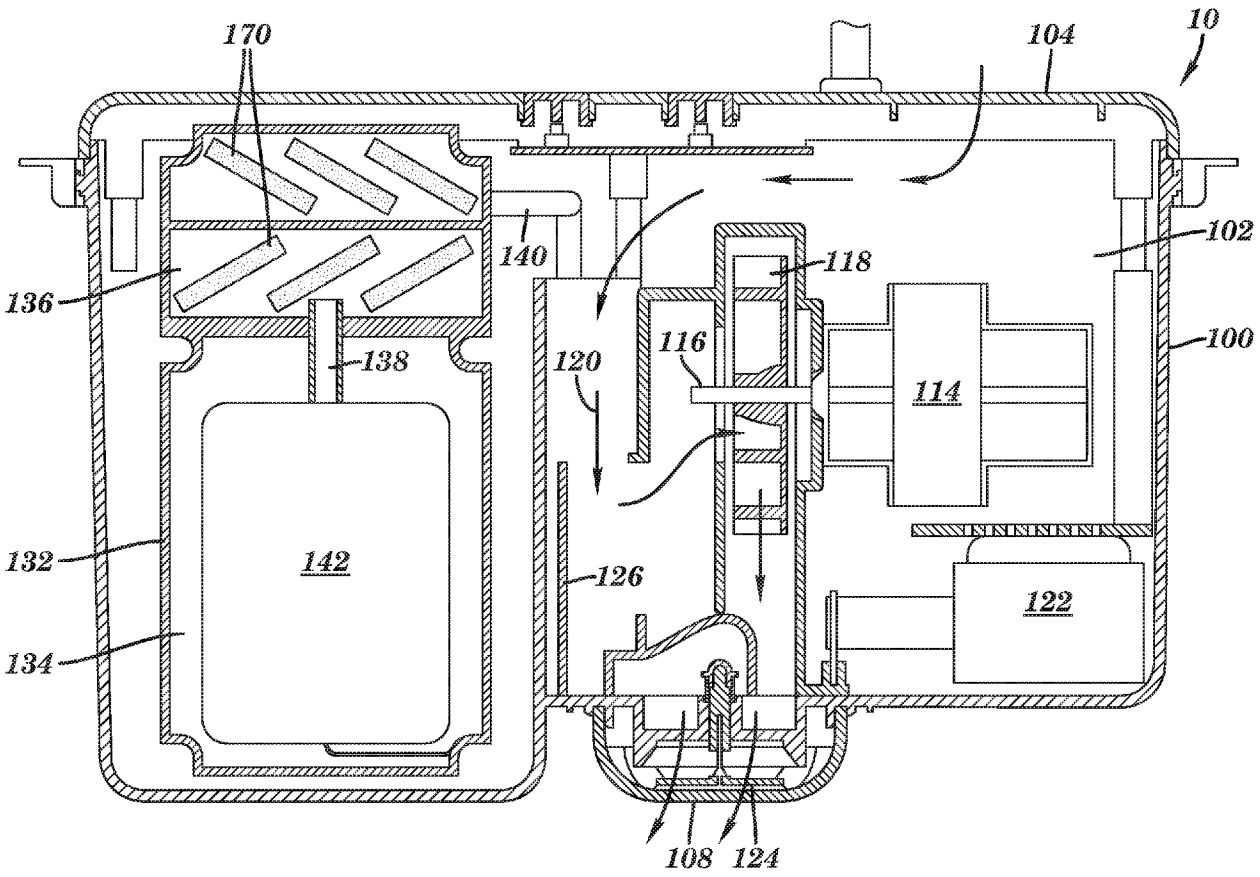
FIG. 5 is a cross-sectional view showing one example of an inflation operation of a first sub-system of an inflating unit constructed in accordance with one or more aspects of the present invention.
Figure 6:
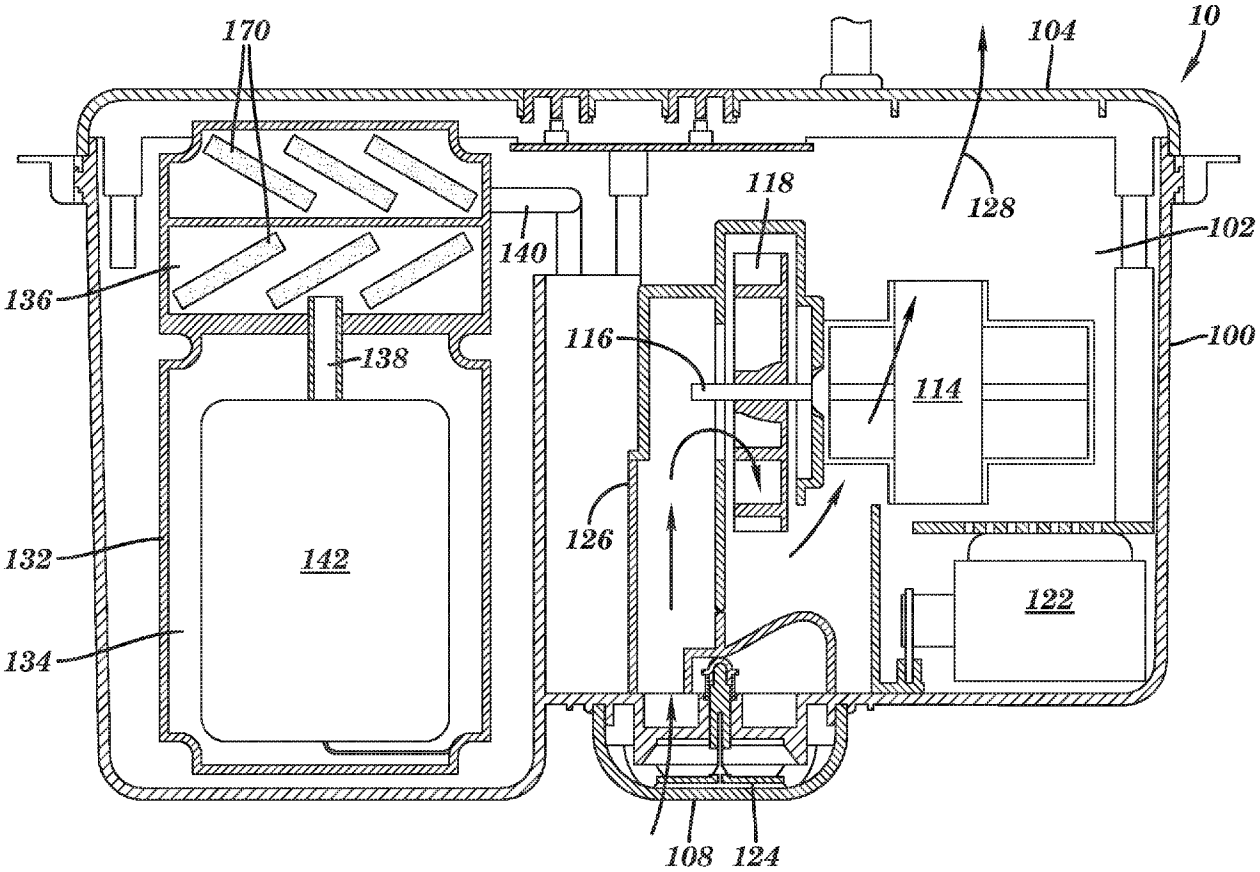
FIG. 6 is a cross-sectional view showing one example of a deflation of a first sub-system of an inflating unit constructed in accordance with one or more aspects of the present invention.

In another aspect, first sub-system 110 may also deflate interior of air bed 50. During deflation, an electric signal is sent to solenoid 122 to open valve 124 to allow air to exit air outlet 124 from the interior of air bed 50 into housing interior 102 and out first air inlet 104. Deflation may be activated by, for example, pressing a button 62 on the outside of housing 102 or on a remote control. Upon pressing button 62, an electric signal is sent to activate solenoid 122 to open valve 124. In one embodiment as illustrated in FIG. 6, reversing plate 126 slides laterally by solenoid 122 to define a flow path, different than the flow path used during inflation as illustrated in FIG. 5, for the air escaping interior of air bed 50 through valve 124 through housing interior 102 and out air inlet 104.

Figure 7:
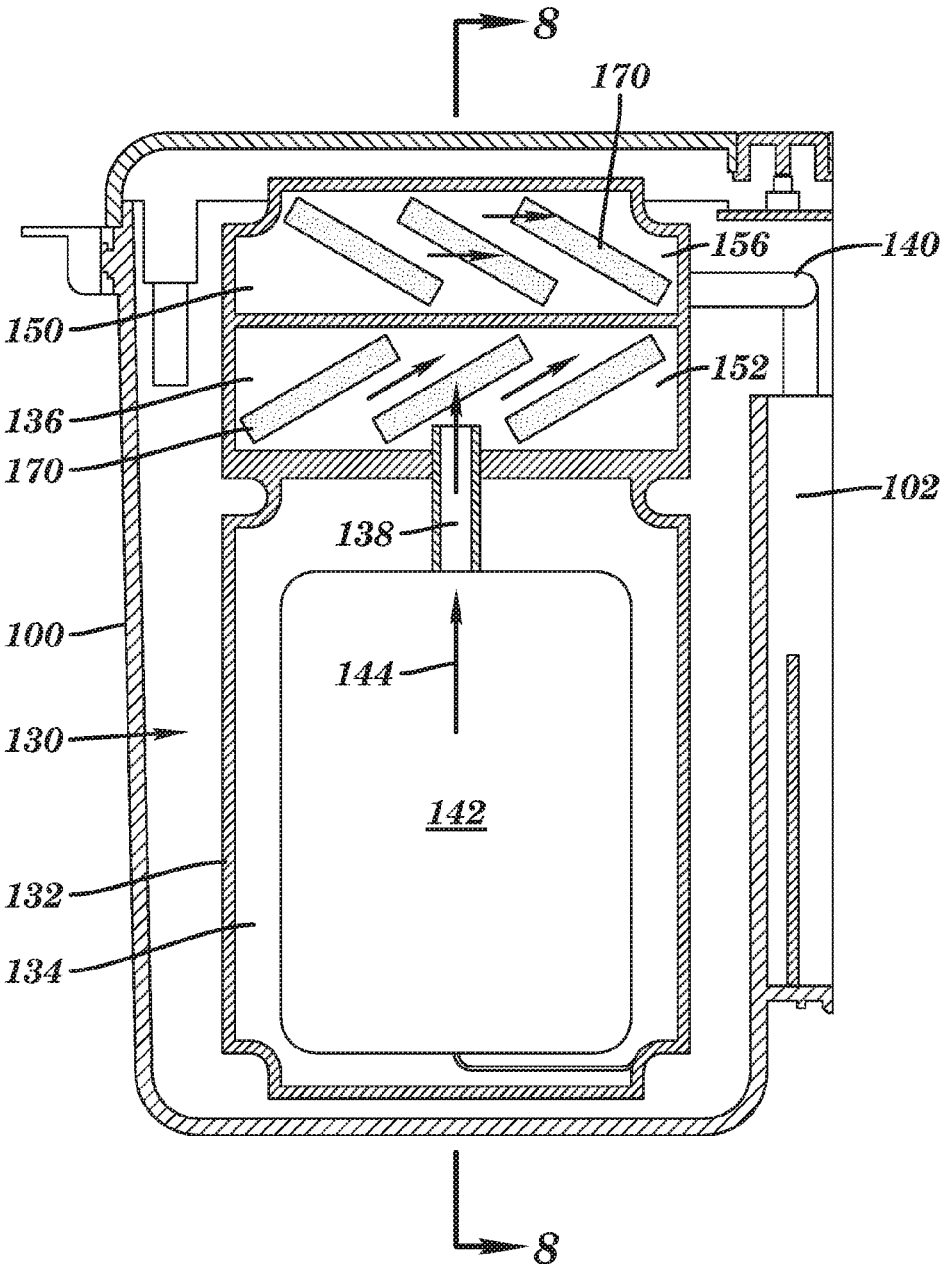
FIG. 7 is a cross sectional view showing one example of a second sub-system of an inflating unit constructed in accordance with one or more aspects of the present invention.
Figure 8:
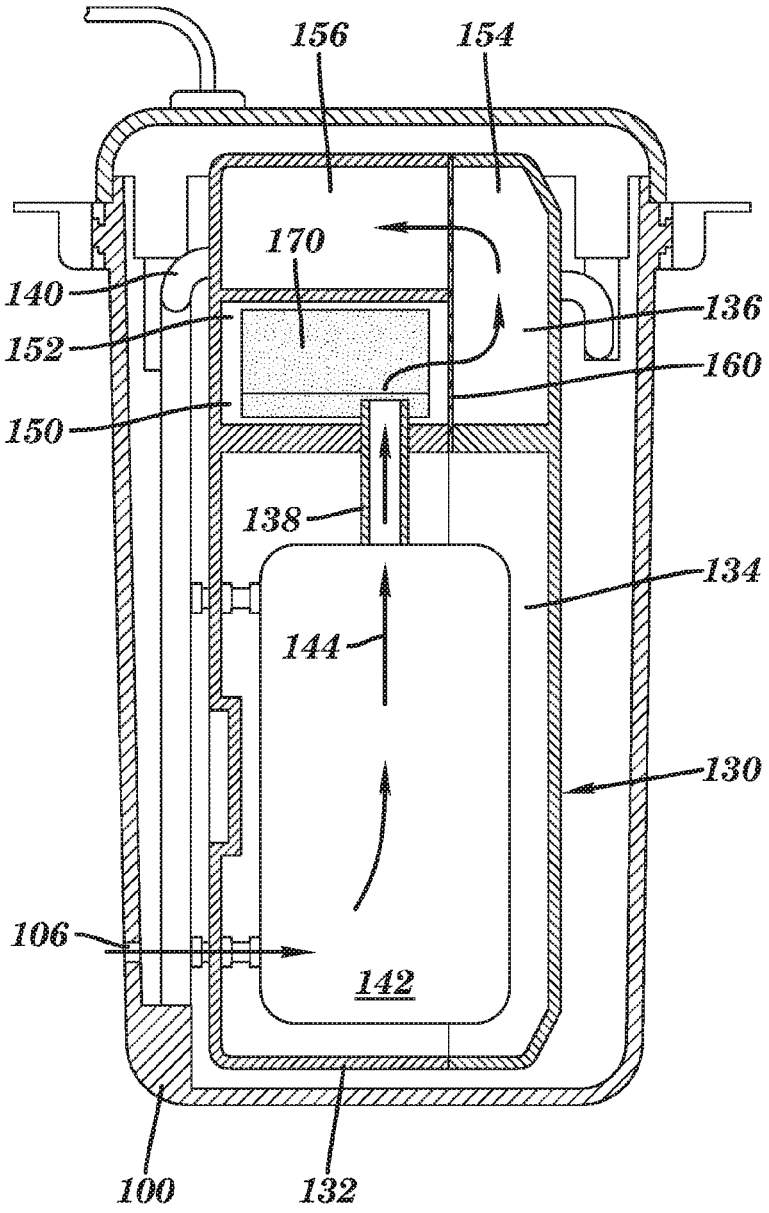
FIG. 8 is a cross-sectional view from line A-A in FIG. 7.
Figure 9:
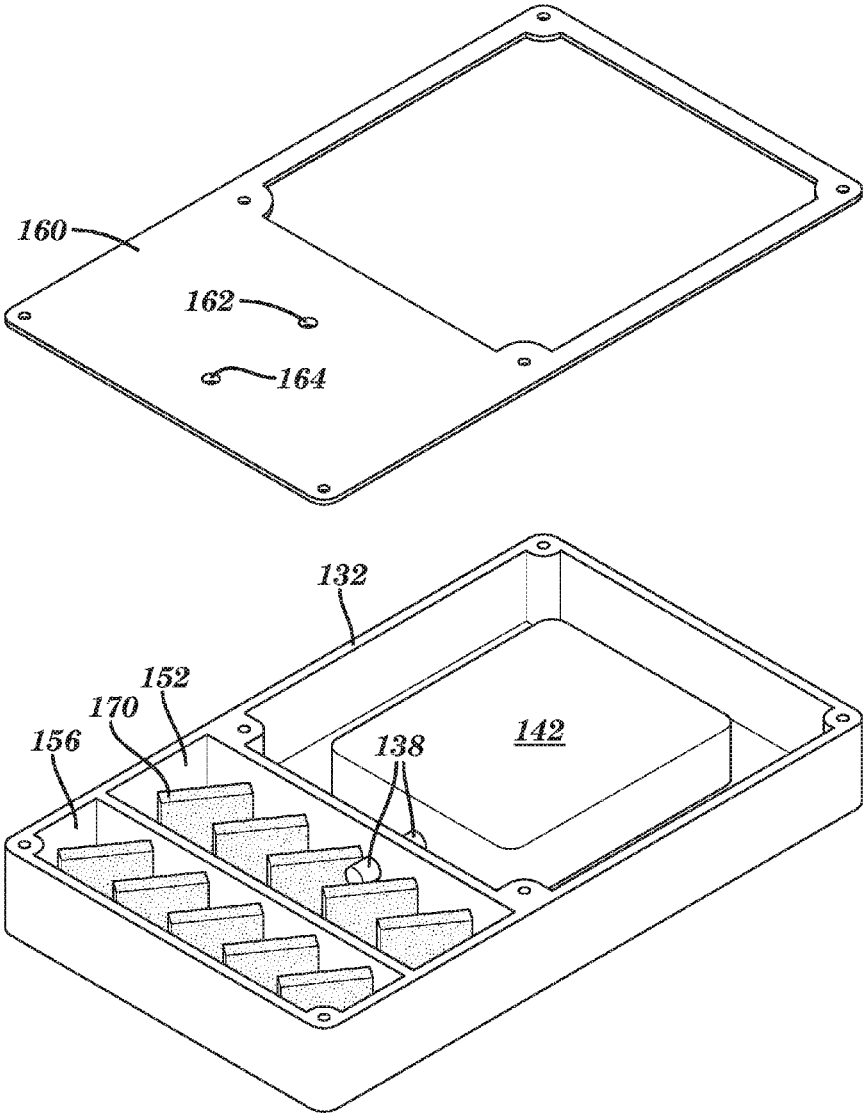
FIG. 9 is a partial exploded view of one example of a diaphragm used by a second sub-system of an inflating unit constructed in accordance with one or more aspects of the present invention.

Second sub-system 130 is configured and programmed to add additional air to interior of air bed 50 after full inflation of air bed 50 if the air pressure within interior of air bed 50 falls below the predetermined threshold programmed into the circuit board. In one embodiment illustrated in FIGS. 3, 7 and 8, second sub-system 130 includes a casing 132 enclosed within housing interior 102. Within casing 132, second sub-system 130 includes a first chamber 134 and a second chamber 136. First chamber 134 is in fluid communication with outside housing 102 through second inlet 106 and with second chamber 136. In one example, first chamber 134 is in fluid communication with second chamber 136 through a tube 138. Second chamber 136 is in fluid communication with housing interior 102. In one example, second chamber 136 is in fluid communication with housing interior 102 through a tube 140.

A motor 142 is provided inside first chamber 134. When the air pressure within interior of air bed 50 falls below the predetermined threshold programmed into the circuit board, an electric signal is sent to activate motor 142. Upon activation, motor 142 draws air into first chamber 134 of casing 132 through second air inlet 106 defined in housing 102 as, for example, indicated by air flow arrows 144 depicted in FIG. 8.

Motor 142 also directs air in first chamber 134 into second chamber 136. Second chamber 136 includes a quiet room 150. Quiet room 150 includes a first cavity 152, a second cavity 154, and a third cavity 156. Air enters first cavity 152 from first chamber 134 through tube 138. In one embodiment, a diaphragm 160 separates first cavity 152, second cavity 154 and third cavity 156. Diaphragm 160 includes a first opening 162 permitting air flow from first cavity 152 into the second cavity 154 and a second opening 164 permitting air flow from second cavity 154 to the third cavity 156. In one embodiment, first cavity 152 and third cavity 156 include noise absorbent material 170. Noise absorbent material 170 may include, for example, foam, cotton or other noise absorbent material known in the art. From third cavity 156, air flows into housing interior 102 through tube 140. Once in housing interior 102, air flows along a portion of the same air flow path used by first sub-system 110 during inflation of air bed 50 to air outlet 124.

When motor 142 of second sub-system 130 is activated, an electric signal is also sent to solenoid 122 to open valve 124 and permit the additional air entering second air inlet 106 through first and second chambers 134, 136 into interior of air bed 50 until the air pressure within interior of air bed 50 again reaches the predetermined, programmed threshold.

Figure 10:
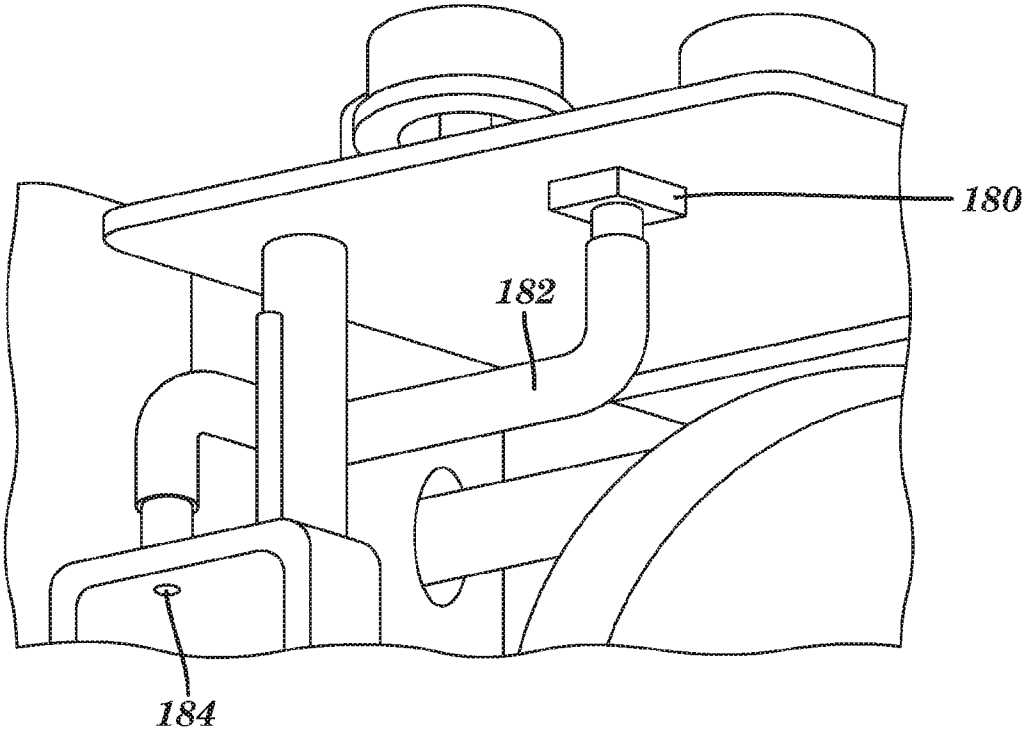
FIG. 10 is a perspective view of one example of an electric pressure sensor in communication with an interior of an inflatable object of an inflating unit constructed in accordance with one or more aspects of the present invention.

In one embodiment illustrated in FIG. 10, inflating unit 100 measures air pressure within the interior of air bed 50 by an electric pressure sensor 180. One example of an electric pressure sensor 180 used by inflating unit 100 is a PCB pressure sensor. In this example, air pressure is monitored through a duct 182 extending between electric pressure sensor 180 and a pressure induction hole 184 communicating directly with the interior of air bed 50. As illustrated in FIG. 2, air induction hole 184 is formed through an outer wall of housing 102. Electric pressure sensor 180 monitors and measures the air pressure within the interior of air bed 50 and sends the measured pressure to, for example, a PC circuit board contained within housing 100 or a remote control for analysis and/or storage. In one example, the air pressure measured by electric pressure sensor 180 is processed and compared to a predetermined threshold or level programmed into a circuit board. If the air pressure measured by electric pressure sensor 180 is below the predetermined threshold, an electric signal is sent to second sub-system 130 to activate motor 142 and draw air in through second air inlet 106 and to activate solenoid 122 to open valve 124 and allow additional air into the interior of air bed 50 until the air pressure within the interior of air bed 50 reaches or exceeds the predetermined threshold. The predetermined threshold may be set by a consumer depending on their desired comfort point. In one example, the air bed will automatically fill air up to that desired point if, for example, air loss is detected to fall below the predetermined threshold or other programmed air pressure loss or amount such as, for example, a 5 psi loss.

In one example of operation of inflating unit 100, a user inflates air bed 50 by pressing an inflation button 62 on the outside of housing 102 or an inflation button on a remote control. Once the inflation button 62 is pressed, an electric signal is sent from a circuit board to activate motor 114 of first sub-system 110 to draw air into housing interior 102 through air inlet 104. Circuit board also sends an electric signal to activate solenoid 122 to open valve 124 and allow air to flow from housing interior 102 and into the interior of air bed 50 through air outlet 108. Air will continue to flow into the interior of air bed 50 until the air pressure detected by electric pressure sensor 180 reaches a predetermined threshold or level stored by the circuit board. Once the air pressure detected by electric pressure sensor 180 reaches or exceeds the predetermined threshold, motor 114 is deactivated and valve 124 is closed by solenoid 122.

After full inflation of air bed 50, electric pressure sensor 180 continues to monitor the air pressure within the interior of air bed 50 through air pressure induction hole 184 and duct 182. If the air pressure within the interior of air bed 50 drops below the predetermined threshold or level, an electric signal is sent from a circuit board to activate motor 142 of second sub-system 130. At the same time motor 142 is activated, circuit board also sends an electric signal to activate solenoid 122 to open valve 124. Motor 142 draws air into casing 132 through second air inlet 106 into first chamber 134 and through tube 138 into first cavity 152 of second chamber 136. Air continues to flow from first cavity 152 through first opening 162 in diaphragm 160 into second cavity 154, then through second opening 164 in diaphragm 160 into third cavity 156 and out tube 140 into housing interior 102. Once in housing interior 102, the additional air flows through a portion of the same air flow path used during inflation of air bed 50 and out through air outlet 108 by valve 124 into the interior of air bed 50. Additional air will continue to be added to the interior of air bed 50 by second sub-system 130 until the air pressure within air bed 50 detected by electric pressure sensor 180 reaches or exceeds the predetermined threshold or level. Once the air pressure detected by electric pressure sensor 180 reaches or exceeds the predetermined threshold, motor 142 is deactivated and valve 124 is closed by solenoid 122.

While embodiments of the invention have been illustrated and described in detail in the disclosure, the disclosure is to be considered as illustrative and not restrictive in character. All changes and modifications that come within the spirit of the invention are to be considered within the scope of the disclosure.

What is claimed is:

1. A unit for inflating an inflatable object having an interior, said unit comprising:

a housing, said housing including a housing interior, a first air inlet, a second air inlet and an air outlet, the first inlet and the second inlet configured to allow air flow between outside said housing and the housing interior, the air outlet configured to allow air flow between the housing interior and the interior of said inflatable object;

a valve, said valve configured to control air flow through the air outlet;

a solenoid, said solenoid configured to selectively open and close said valve in response to an electric signal;

a first sub-system, said first sub-system enclosed within the housing interior, said first sub-system programmed to activate said solenoid and open said valve to inflate said inflatable object to a predetermined threshold, said first sub-system including:

a first motor, the first motor including a drive shaft, an impeller affixed to the drive shaft of the first motor, the first motor and the impeller selectively activated in response to an electric signal to allow air to flow between the first air inlet of said housing and the interior of said inflatable object through said valve;

a second sub-system, said second sub-system including a casing, the casing contained within the housing interior, the casing including a first chamber and a second chamber, the first chamber in fluid communication with the second air inlet and with the second chamber, the second chamber in fluid communication with the housing interior outside the casing, said second sub-system programmed to activate said solenoid and open said valve to provide additional air flow to the interior of said inflatable object from the second air inlet after said inflatable object is inflated by said first sub-system to the predetermined threshold and after pressure within said inflatable object falls below the predetermined threshold, said second sub-system including:

a second motor, the second motor contained within the first chamber of the casing, the second motor configured to draw air through the second air inlet into the casing in response to an electric signal, a quiet room, the quiet room contained within the second chamber of the casing, the quiet room including a first cavity, a second cavity, a third cavity, and a diaphragm separating the first cavity, second cavity and third cavity, the diaphragm including a first opening permitting air flow from the first cavity into the second cavity and a second opening permitting air flow from the second cavity to the third cavity, at least the first cavity and the third cavity including noise absorbent material contained therein, an electric pressure sensor, said electric pressure sensor configured to monitor air pressure in the interior of said inflatable object, the air pressure monitored by said electric pressure sensor is compared to the predetermined threshold to selectively activate the second motor and the solenoid.

2. The inflating unit of claim 1, wherein said second sub-system includes a first tube extending between the first chamber and the second chamber, the tube allowing air to flow from the first chamber into the second chamber.

3. The inflating unit of claim 1, wherein said second sub-system includes a second tube extending between the second chamber and the housing interior outside the casing, the second tube allowing air to flow from the second chamber into the housing interior outside the casing and into the interior of the inflatable object through the air outlet.

4. The inflating unit of claim 1, further including at least one circuit board configured to send electric signals to activate the solenoid.

5. The inflating unit of claim 1, further including at least one circuit board configured to send electric signals to activate the first motor.

6. The inflating unit of claim 1, further including at least one circuit board configured to send electric signals to activate the second motor.

7. The inflating unit of claim 6, wherein the at least one circuit board is programmed to activate the second motor until the pressure within the interior of the inflatable object monitored by the electric pressure sensor raises above the predetermined programmed threshold.

8. The inflating unit of claim 7, wherein the at least one circuit board stores the predetermined programmed threshold.

9. The inflating unit of claim 1, wherein said electric pressure sensor monitors pressure within the interior of said inflatable object through a tube extending from said electric pressure sensor and a pressure induction hole in fluid communication with the interior of said inflatable object.

10. The inflating unit of claim 1, wherein the first sub-system and the second sub-system share at least a portion of a common air flow path within said housing interior.

11. The inflating unit of claim 1, furthering comprising a reversing plate, wherein said solenoid shifts the reversing plate to define different air flow paths depending on whether the inflating unit is inflating the inflatable object, adding additional air into the interior of the inflatable object or deflating the inflatable object.

* * * * *